United States Patent [19]

Bachmann et al.

[11] 4,454,670

[45] * Jun. 19, 1984

[54] VENDING MACHINE DISPLAY PANEL WITH UTILITY MODULE THEREIN

[75] Inventors: G. Merle Bachmann, Stone Mountain; Charles L. Davis; Annis R. Morgan, Jr., both of Atlanta, all of Ga.

[73] Assignee: The Coca-Cola Company, Atlanta, Ga.

[ * ] Notice: The portion of the term of this patent subsequent to Nov. 15, 2000 has been disclaimed.

[21] Appl. No.: 327,461

[22] Filed: Dec. 4, 1981

Related U.S. Application Data

[63] Continuation-in-part of Ser. No. 244,818, Mar. 17, 1981, Pat. No. 4,380,130.

[51] Int. Cl.[3] ..... G09F 7/00

[52] U.S. Cl. ..... 40/584; 194/1 A

[58] Field of Search ..... 40/1, 331, 332; 194/1 A, 584; 221/15

[56] References Cited

U.S. PATENT DOCUMENTS

| | | | |
|---|---|---|---|
| D. 175,812 | 10/1955 | Waif . | |
| D. 192,937 | 5/1962 | Conde . | |
| D. 221,184 | 7/1971 | Cathey . | |
| D. 256,031 | 7/1980 | Moore . | |
| D. 266,337 | 9/1982 | Bachmann et al. . | |
| D. 267,498 | 4/1983 | Bachmann et al. . | |
| 2,077,847 | 4/1937 | Meusner | 40/332 |
| 2,792,920 | 5/1957 | Sutphen et al. . | |
| 2,853,585 | 9/1958 | Danziger | 40/331 |
| 3,122,269 | 2/1964 | Redburn | 221/15 |
| 3,176,815 | 4/1965 | Farinola . | |
| 3,186,588 | 6/1965 | Chapman . | |
| 3,224,544 | 12/1965 | Shoher . | |
| 3,258,153 | 6/1966 | Morgan et al. . | |
| 4,213,524 | 7/1980 | Miyashita et al. . | |
| 4,229,893 | 10/1980 | Naudw | 40/332 |
| 4,245,730 | 1/1981 | Bachmann et al. | 194/1 A |
| 4,320,933 | 3/1982 | Felix et al. . | |
| 4,326,620 | 4/1982 | Felix et al. . | |
| 4,377,049 | 3/1983 | Simon et al. . | |

*Primary Examiner*—Gene Mancene
*Assistant Examiner*—Wenceslao J. Contreras
*Attorney, Agent, or Firm*—Birch, Stewart, Kolasch & Birch

[57] ABSTRACT

A display panel for a vending machine including the capability of adding promotions, advertising, and special equipment such as electronic and video games to the existing vending machine. A utility module for containing one of these devices is located on the display panel of the vending machine and is so positioned so that it optimizes a combination of criteria including space, circuitry location, a prominent spot for display purposes and a location enabling easy retrofit of the utility module into a vending machine unit.

25 Claims, 4 Drawing Figures

VENDING MACHINE DISPLAY PANEL WITH UTILITY MODULE THEREIN

This application is a continuation-in-part of prior application Ser. No. 244,818 filed Mar. 17, 1981 by the same inventors, which is now U.S. Pat. No. 4,380,130 issued Apr. 19, 1983. Other related U.S. applications include a divisional thereof which is now U.S. Pat. No. 4,414,768, issued Nov. 15, 1983.

FIELD OF THE INVENTION

The present invention relates to display panels for vending machines and more particularly to improved configurations for same in combination with suitable control panel configurations within said display panel.

BACKGROUND OF THE INVENTION

In the vending of beverages from vending machines, particularly those beverages packaged in cans, bottles, or generally similar symmetrical containers, the display panels of the vending machines involved should perform certain point-of-purchase functions. For example, the nature of the products vended should be instantly apparent to a potential customer. The identity of the source or origin (manufacturer) of the products being vended should be either directly provided or provided by means such as logos or other symbolic means suggestive thereof.

Further, if there is a primary product for which the vending machine has more capacity or for which greater sales volume is desired, the vending machine should be capable of encouraging the selection of this product over the other products (secondary products) present in the machine.

The display panel face should also be capable of containing a utility module or area disposed in an optimum location for viewing and interfacing with the internal electrical controls of the vending machine.

It is an object of the present invention to provide a new and novel display panel configuration for vending machines.

Another object of the present invention is to provide a new and novel display panel for vending machines by combining the configuration and selective backlighting of panel sections on the obverse face of a vending machine to both directly and symbolically identify the manufacturer (source or orgin) of the products being vended.

Still another object of the present invention is to provide new and novel display panel for vending machines which suggest to a potential customer the packaged configuration of a product to be vended.

Yet another object of the present invention is to provide a new and novel display panel configuration for vending machines which, together with identifying products and the sources of such products, provides an inducement to a customer to purchase a particular primary one of a plurality of products made available by the vending machine bearing that display panel.

It is a further object of the present invention to provide a utility module area within the display panel of a vending machine making the module suitable for use for point-of-sale advertising, voice synthesized or recorded messages, electronic or video games, coupon dispensers or other suitable equipment.

These and other objects of the present invention will become more fully apparent with reference to the following specification and drawings which relate to several preferred embodiments of the display panel structure of the invention.

SUMMARY OF THE INVENTION

The objects of the present invention are fulfilled in part by providing a vending machine of the types described in applicants' prior patent application Ser. No. 244,818 filed Mar. 17, 1981 of which this application is a continuation-in-part. Prior U.S. application Ser. No. 244,818 filed Mar. 17, 1981 is incorporated herein by reference.

The present invention is an improvement over the prior afore-mentioned application and is intended to add more utility to the display panel of the vending machine disclosed therein including the capability of providing promotions, advertising, and special equipment such as electronic and video games to the existing vending machine. To achieve this capability, it is necessary to select a location on the display panel of the vending machine in which a utility module may be so positioned so that it optimizes a combination of criteria including space, circuitry location, a prominent spot for display purposes and a location enabling easy retrofit of a utility module into a vending machine unit. Applicants' have discovered that this optimum location is just above the coin slot of the vending machine control panel in line with the vertical array of selector buttons. This location achieves all of the afore-mentioned criteria.

BRIEF DESCRIPTION OF THE DRAWINGS

The objects of the present invention and the attendant advantages thereof will become more readily apparent by reference to the accompanying drawings wherein like reference numerals refer to like parts and wherein.

DETAILED DESCRIPTION OF THE DRAWINGS

Figure 1:
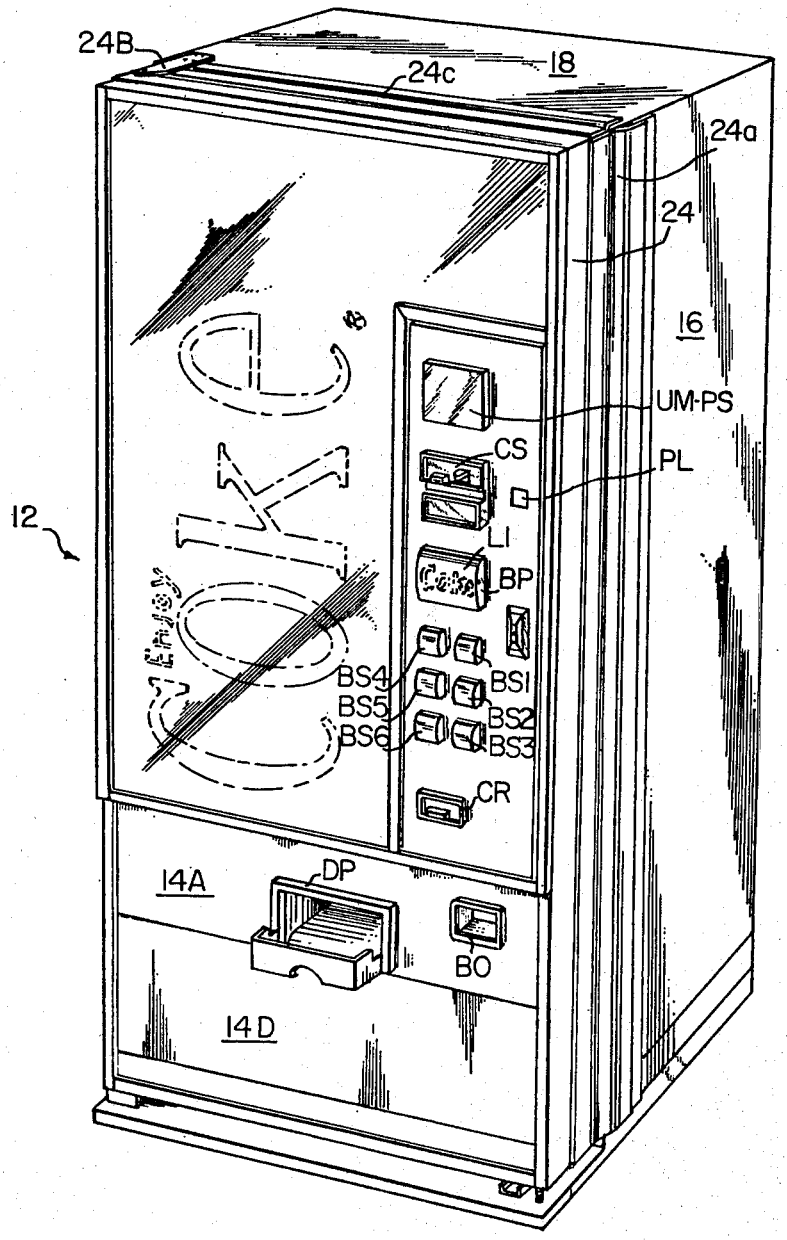
FIG. 1 is a front perspective view of a vending machine in accordance with the present invention including a point-of-sale advertising module disposed above the coin slot in the control panel.

Referring to FIGS. 1 to 4, a vending machine 12 incorporating the display panel 14 of the present invention is illustrated as being a basically three dimensional rectangular structure having vertical sides 16 joining horizontal top and bottom sides 18 and 20, respectively. The structure of the vending machine 12 is completed by a flat planar rear surface and a front panel comprising a door 24 which includes the display panel 14 as the obverse face thereof.

The door 24 includes a sealing skirt 24A along one vertical edge thereof and is provided with hinges 24B at the top and bottom of the door on the opposite vertical sidethereof to permit access to the interior of the vending machine 12. The bottom surface 20 of the vending machine 12 is illustrated as a load bearing pad or the like which extends outwardly from the main body portion of the machine 12 beneath the door structure 24 and display panel 14.

A further overlapped sealing skirt structure 24C extends across the top of the door 24 and cooperates with the top surface 18 of the vending machine 12.

The display panel 14 of the present invention includes a first transversely disposed opaque field section 14A located below the median height of the panel 14 in the preferred embodiment illustrated, in which a discharge port DP and a bottle opener BO are positioned side by side.

A second opaque field 14B comprising the selection contrast, portion of the display panel 14 is basically rectangular in shape in the embodiment illustrated and extends vertically from the upper right hand side of the transversly disposed first opaque field 14A. The vertical extent of the second opaque field (control panel) 14B is variable in the several preferred embodiments illustrated herein but in the preferred embodiments of FIGS. 1 and 2 extends from the upper edge of the transversely disposed first opaque field 14A to a point intermediate that edge and the uppermost edge of the display panel 14 of the present invention.

The remaining area above the uppermost edge of the first opaque field 14A and the top of the display panel 14 of the present invention is of an inverted L shape which is completely defined by a first contrasting panel 14C which is translucent and is back-lighted in a manner well known in the art, such as for example, the back-lighting arrangement illustrated in U.S. Pat. No. 4,245,730 of Bachmann et al, for "Display Panel for a Vending Machine" issued on Jan. 20, 1981. The first contrasting panel 14C carries a logo L which is printed out for illustration and which in the embodiment shown serves to suggest, in combination with the manner of positioning the logo L thereon, a container shaped such as a can of the beverage "Coca-Cola," a Trademark of the Coca-Cola Company of Atlanta, Ga. The logo illustrated is for "Coke" which is also a well-known trademark of the company. Thus, the first contrasting panel with its logo serves to suggest to a potential purchaser utilizing the vending machine 12, a can of "Coke".

Figure 2:
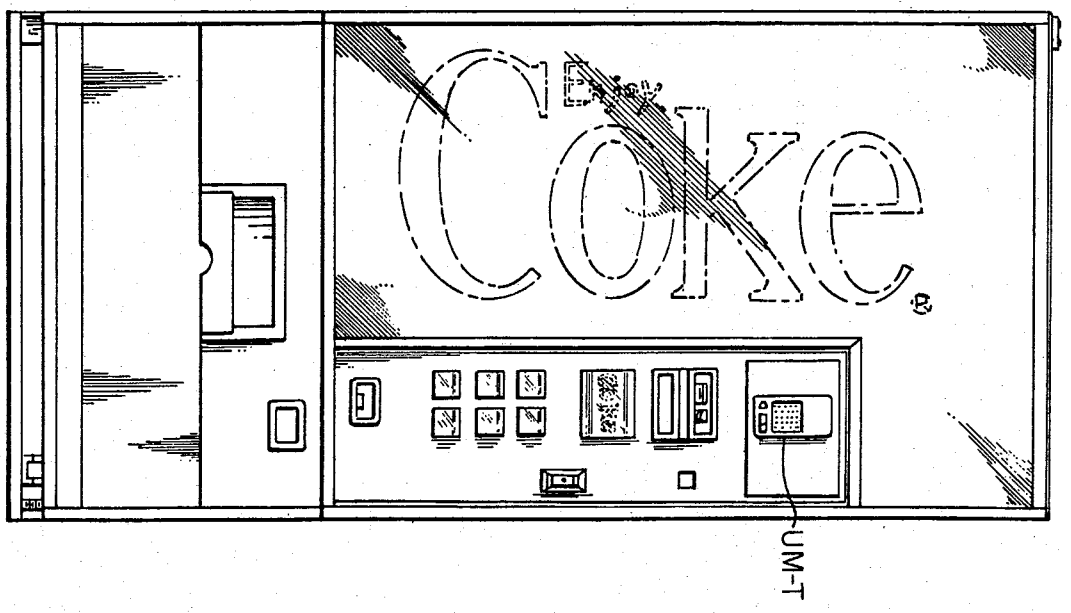
FIG. 2 is a front elevational view of a vending machine in accordance with the present invention including a synthetic voice or recorded message module disposed above the coin slot of the vending machine.

Beneath the lower edge of the first opaque field 14A is a transversely disposed second contrasting panel 14B which can be of various configurations or contrasting color zones, as desired, but which in the illustration of the preferred embodiment of FIGS. 1 and 2 constitutes a transversely disposed rectangular field which in combination with the shape (inverted L) of the first contrasting panel 14C provides a suggestion of the letter "C" which is an abbreviation for "COKE", the logo displayed on the first contrasting panel.

The presentation of goods within the vending machine 12 and the selection thereof for vending is accomplished by the second opaque field (control panel) 14B which includes the following components:

At the upper most edge of the control panel 14B is a coin-slot and return mechanism CS adjacent to which is a pricing label PL which display a price for the various goods to be dispensed by the vending machine 12.

Beneath the coin slot mechanism CS is an enlarged primary product selector button BP which subtends two vertical columns of secondary product selector buttons BS1 through BS6, the secondary product selector buttons BS1–BS3 constituting one column and the secondary product selector buttons BS4–BS6 constituting a second vertical column parallel to the first.

All of the product selector buttons BP, BS1 . . . , BS6 carry various logos or symbols identifying the products corresponding thereto within the vending machine 12.

In the case of the primary product selector button BP, the logo L1 thereon is identical to the logo L on the first contrasting panel 14C. This combination of the primary product logo L with its abstract suggestion of a can of the primary product beverage, in this specific example, together with the identical logo L1 on the primary product selector button BP provides a strong and effective inducement to a purchaser to purchase the primary product in the machine 12 in preference to all of the secondary products provided thereby.

This inducement to purchase is further enhanced by the combination of shapes presented by the first and second contrasting panels 14C and 14D, respectively, which superimpose an additional effect of a character which is an abbreviation for the primary product. This abbreviation for the primary product can also be an abbreviation for the manufacturer of the primary product depending upon the combined effect desired.

The control panel 14B (second opaque field) is completed by the provision of an access locking mechanism AL at the right hand edge thereof in a relatively medial position and a coin return slot CR at the lowermost edge portion thereof.

Preferably, the selector buttons BP, BS1 . . . BS6 all are provided with translucent indicia, and are back-lighted in a suitable manner known in the art to further emphasize and present the purchaseable contents of the vending machine 12 to a potential customer. The back-lighting of the enlarged primary product selector button BP even further augments the presence of that primary product selector button and provides it with even more dominance over the subtended secondary product selector buttons BS1 . . . BS6 in the two vertical columns therebeneath.

The above description essentially describes the FIG. 1 embodiment of the afore-mentioned parent application Ser. No. 244,818 filed Mar. 17, 1981 which is now U.S. Pat. No. 4,380,130 issued Apr. 19, 1983. FIGS. 1 to 4 illustrates the various utility modules of the present invention combined with that FIG. 1 embodiment. It should be understood that the utility modules of FIGS. 1 to 4 may also be combined with all other embodiments of the vending machines in the aforementioned U.S. patent by placing those modules directly above the coin slots thereof.

Referring further to FIG. 1 there is illustrated a point-of-sale advertising utility module UM-PS disposed just above the coin slot of the vending machine within the control panel area. This area is covered by a polycarbonate lens which may be back-lighted to illuminate the same. A suitable transparent strip bearing advertising indicia may be inserted in a slot provided in the polycarbonate lense. This tranparent strip may be similar to those strips inserted into the primary and secondary product selector buttons BP and BS. The visual area of point-of-sales advertising lens may be approximately the same dimension as the enlarged primary product BP so as to geometrically match current alignment and styling of the selection panel of the vending machine described in the aforementioned parent application. Self-adhesive labels can be used in place of a back-lighted display if the polycarbonatelense area is covered by a metal plate.

Referring in detail to FIG. 2 there is illustrated a front elevational view of a vending machine which is essentially the same as that of FIG. 1 with the exception that the utility module illustrated is a talking device UM-T designed to audibly transmit various speech messages to the user of the vending machine. It is particularly advantageous that the talking module UM-T be disposed in this location because it is adjacent the suitable circuitry for controlling the vending machine and fits nicely into the space just above the coin slot.

Figure 3:
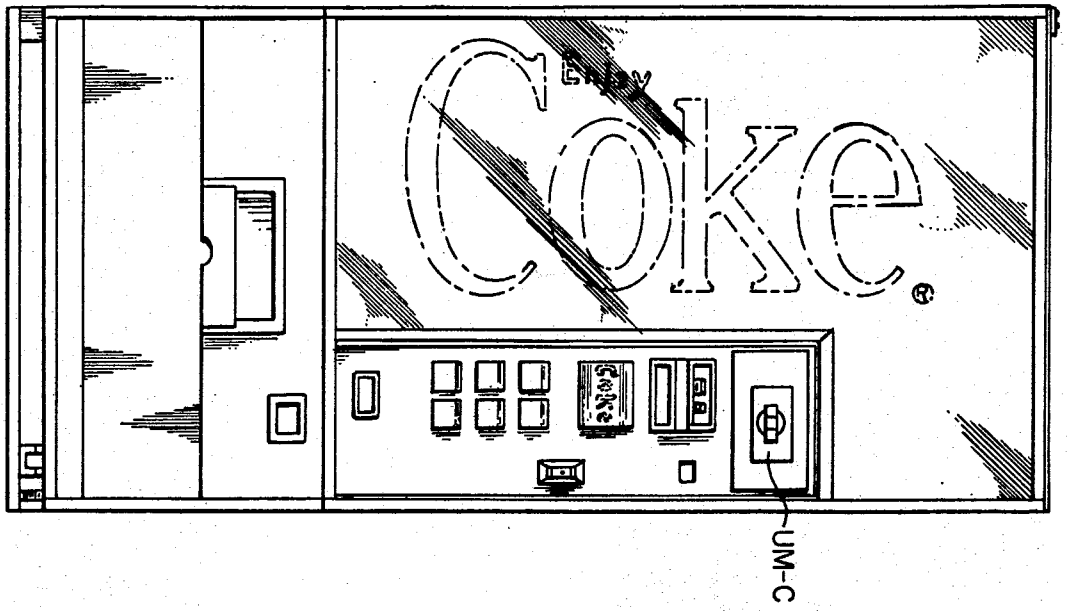
FIG. 3 is a front elevational view of a vending machine in accordance with the present invention including a coupon dispenser disposed above the coin slot of the vending machine.

Referring in detail to FIG. 3 there is illustrated a front elevational of a view of a vending machine in accordance with the present invention including a utility module in the form of a coupon dispenser UM-C above the coin slot. The other components illustrated in the vending machine of FIG. 3 correspond to the components described in connection with the FIG. 1. Again it is particularly advantageous to dispose the coupon module C directly above the coin slot in line with the vertical selector button array because in this position it is easily interconnected with the control electronics of the vending machine and is positioned in a convenient space for other reasons described hereinbefore.

Figure 4:
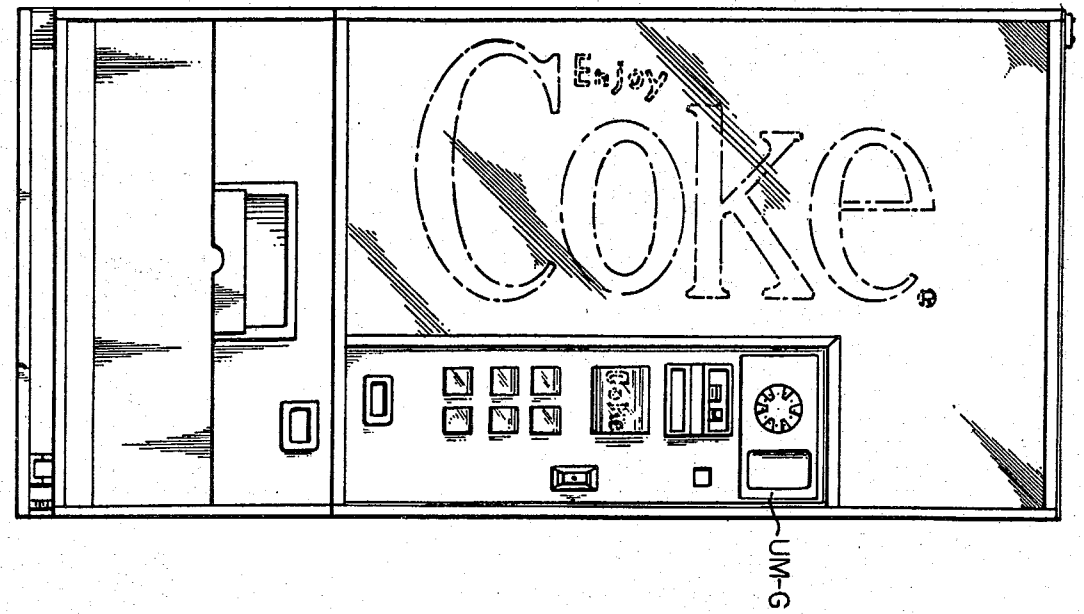
FIG. 4 is a vending machine in accordance with the present invention including an electronic game module disposed above the coin slot of the vending machine.

Referring in detail to FIG. 4 there is illustrated a front elevational view of a vending machine in accordance with the present invention including an electronic game module UM-G to be played by the user of the machine. The game illustrated in FIG. 4 is an electronic roulette game, but other electronic games such as video games may be inserted in the location of the game module UM-G in the embodiment of FIG. 4. As in the embodiments of FIGS. 1 to 3 the location of the game module in this particular location above the coin slot and in line with the vertical array of product selection buttons is an optimum location for this module.

Accordingly, each of the embodiments of FIGS. 1 to 4 of the present invention provide a utility area just above the coin slot of the vending machine. By extending the product selection and control panel approximately 10 inches vertically and retaining the same horizontal width, an area is created whereby point-of-sale advertising can be placed or some special equipment such as a talking module, game module, coupon dispenser or other special equipment.

It should be understood that the vending machine display panel and utility module therein described herein before may be modified as would occur to one of ordinary skill in the art without departing from the spirit and scope of the present invention.

What we claim is:

1. A vending machine including a control panel with an array of product selector buttons for controlling the vending of products from said machine, comprising:

a coin slot for receiving coins to initiate vending of products;

first and second adjacent vertical columns of product selector buttons, each having a product display area thereon bearing indicia representative of a given product to be vended;

utility module means disposed in said control panel above said coin slot for providing interactive communication with a customer using said machine, who inserts coins into said coin slot and actuates at least one of said product selector buttons;

a plurality of panel means adjacent said control panel defining a like plurality of display fields within a defined display area;

selected ones of said panel means being of contrasting surface characteristics to the remaining said panel means in the provision of selected display configurations in said display area;

one of said selected ones of said display panel means including logo means definitive of a primary product to be dispensed by said vending machine; and the remaining said selected ones of said display panel means being so configured, in conjunction with said one of said selected panel means, as to suggest the representation by said display panel means of an alphanumeric character representative of the said primary product in addition to said logo means, said alphanumeric character being an abbreviation for said primary product.

2. The vending machine of claim 1, wherein said contrasting surface characteristics comprise different colors.

3. The vending machine of claim 1, wherein at least said one of said selected ones of said display panel means is backlighted.

4. The vending machine of claim 1, further including at lest one primary product selector button positioned between said first and second columns of product selector buttons and said coin slot and being so shaped and proportioned to overlie and extend across both said vertical columns of product selector buttons and present a display area thereon larger than the display area on the other product selector buttons.

5. The vending machine of claim 1, wherein said utility module means is a device which is either a, (1) point-of-sale display means for generating interchangeable advertising messages to said customer, or (2) voice synthesizer means for generating speech messages to said customer, or (3) electronic game means to be played by said customer, or (4) coupon dispenser means for dispensing coupons to said customer, and further including utility area means in said control panel for interchangeably accommodating a selected one of said utility module means in operative association with said coin slot and product selection buttons.

6. A vending machine including a control panel with an array of product selector buttons for controlling the vending of primary and secondary products from said machine, comprising:

a coin slot for receiving coins to initiate vending of products;

first and second adjacent vertical columns of product selector buttons, each having a product display area thereon bearing indicia representative of a given secondary product to be vended;

utility module means disposed in said control panel above said coin slot for providing interactive communication with a customer using said machine, who inserts coins into said coin slot and actuates at least one of said product selector buttons;

display panel means for presenting selected display configurations on an obverse face of said vending machine, said display panel means comprising;

first panel means including discharge port means for presenting vended products defining a first display field disposed on said display panel means, second panel means including said control panel defining a second display field extending from one end of said first display field, third panel means mutually adjacent said first and second display fields defining a third display field subtending an area on said display panel means defined by the outer boundaries thereof and the said first and second display fields, and fourth panel means defining a fourth display field beneath said first display field, substantially subtending an area defined by the latter and the outer boundaries of said display panel means, said third panel means including logo means thereon representative of primary product to be vended, and said fourth panel means being so configured in combination with the other said panel means as to suggest the representation of by said display panel means of an alphanumeric character representative of said primary product in addition to said logo means, said alphanumeric character being an abbreviation for said primary product.

7. The vending machine of claim 6, wherein said third and fourth panel means are the same color and are different in color from said first and second panel means.

8. The vending machine of claim 6, wherein said third panel means is backlighted.

9. The vending machine of claim 6, further including at least one primary product selector button positioned between said first and second columns of product selector buttons and said coin slot and being so shaped and proportioned to overlie and extend across both said vertical columns of product selector buttons and present a display area thereon larger than the display area on the other product selector buttons.

10. The vending machine of claim 6, wherein said utility module means is a device which is either a, (1) point-of-sale display means for generating interchangeable advertising messages to said customer, or (2) voice synthesizer means for generating speech messages to said customer, or (3) electronic game means to be played by said customer, or (4) coupon dispenser means for dispensing coupons to said customer, and further including utility area means in said control panel for interchangeably accommodating at least one of said utility module means in operative association with said coin slot and product selection buttons.

11. A vending machine including a control panel with an array of product selector buttons for controlling the vending of products from said machine comprising:

(a) a coin slot for receiving coins to initiate vending of products;

(b) first and second adjacent vertical columns of product selector buttons in said array disposed below said coin slot, each having a product display area thereon bearing indicia representative of a given product to be vended;

(c) utility module means disposed in said control panel adjacent said coin slot for providing interactive communication with a customer using said machine, who inserts coins into said coin slot and actuates at least one of said product selector buttons, said utility module means being a device which is either a, (1) point-of-sale display means for generating interchangeable advertising messages to said customer, or (2) voice synthesizer means for generating speech messages to said customer, or (3) electronic game means to be played by said customer, or (4) coupon dispenser means for dispensing coupons to said customer; and (d) utility area means in said control panel for interchangeably accommodating a selected one of said utility module means in operative association with said coin slot and product selector buttons.

12. The vending machine of claim 11, wherein said product selector buttons in said vertical columns are disposed in a plurality of parallel rows with two selector buttons per row.

13. The vending machine of claim 12, wherein there are at least two of said rows.

14. The vending machine of claim 11, further comprising price display means on said control panel adjacent to said coin slot.

15. The vending machine of claim 11, wherein said utility area means overlies and extends across said first and second adjacent vertical columns of product selector buttons.

16. The vending machine of claim 15, wherein said utility area means is a rectangle with vertically disposed sides thereof substantially in vertical alignment with outside edges of said first and second adjacent vertical columns of product selector buttons.

17. A vending machine including a control panel with an array of product selector buttons for controlling the vending of products from said machine comprising:

(a) a coin slot for receiving coins to initiate vending of products;

(b) first and second adjacent vertical columns of product selector buttons, each having a product display area thereon bearing indicia representative of a given product to be vended;

(c) utility module means disposed in said control panel above said coin slot for providing interactive communication with a customer using said machine, who inserts coins into coin slot and actuates at least one of said product selector buttons; and (d) at least one primary product selector button positioned between said first and second columns of product selector buttons and said coin slot and being so shaped and proportioned to overlie and extend across both said vertical columns of product selector buttons and present a display area thereon larger than the display area on the other product selector buttons.

18. The vending machine of claim 17, wherein said utility module means is a device which is either a, (1) point-of-sale display means for generating interchangeable advertising messages to said customer, or (2) voice synthesizer means for generating speech messages to said customer, or (3) electronic game means to be played by said customer, or (4) coupon dispenser means for dispensing coupons to said customer;

and further including utility area means in said control panel for interchangeably accommodating a selected one of said utility module means in operative association with said coin slot and product selection buttons.

19. The vending machine of claim 18, wherein said utility area means overlies and extends across said first and second adjacent vertical columns of product selector buttons.

20. The vending machine of claim 18, wherein said utility area means is substantially the same size as the display area on said primary product selector button.

21. The vending machine of claim 17, wherein said utility area means is a rectangle with vertically disposed sides thereof substantially in vertical alignment with outside edges of said first and second adjacent vertical columns of product selector buttons.

22. A vending machine including a control panel with an array of product selector buttons for controlling the vending of products from said machine, comprising:

a coin slot for receiving coins to initiate vending of products;

first and second adjacent vertical columns of product selector buttons, each having a product display area thereon bearing indicia representative of a given product to be vended;

message display means adjacent to said coin slot for displaying instructions related to the operation of said vending machine; and point-of-sale display means disposed above said message display means in said control panel for supporting interchangeable advertising messages.

23. A vending machine including a control panel with an array of product selector buttons for controlling the vending of products from said machine, comprising:

a coin slot for receiving coins to initiate vending of products;

first and second adjacent vertical columns of product selector buttons, each having a product display area thereon bearing indicia representative of a given product to be vended;

message display means adjacent to said coin slot for displaying instructions related to the operation of said vending machine; and means for generating speech messages disposed above said message display means in said control panel.

24. A vending machine including a control panel with an array of product selector buttons for controlling the vending of products from said machine, comprising:

a coin slot for receiving coins to initiate vending of products;

first and second adjacent vertical columns of product selector buttons, each having a product display area thereon bearing indicia representative of a given product to be vended;

message display means adjacent to said coin slot for displaying instructions related to the operation of said vending machine; and electronic game means disposed above said message display means in said control panel.

25. A vending machine including a control panel with an array of product selector buttons for controlling the vending of products from said machine, comprising:

a coin slot for receiving coins to initiate vending of products;

first and second adjacent vertical columns of product selector buttons, each having a product display area thereon bearing indicia representative of a given product to be vended;

message display means adjacent to said coin slot for displaying instructions related to the operation of said vending machine; and coupon dispenser means disposed above said message display means in said control panel.

* * * * *